US007547018B2

(12) United States Patent
Lin

(10) Patent No.: US 7,547,018 B2
(45) Date of Patent: Jun. 16, 2009

(54) DRAWING MACHINE FOR MULTIPLE GAMES

(75) Inventor: Yueh-Chun Lin, Taichung (TW)

(73) Assignee: Jumbo Technology Co., Ltd., Taichung (TW)

( * ) Notice: Subject to any disclaimer, the term of this patent is extended or adjusted under 35 U.S.C. 154(b) by 645 days.

(21) Appl. No.: 10/950,510

(22) Filed: Sep. 28, 2004

(65) Prior Publication Data

US 2006/0066045 A1 Mar. 30, 2006

(51) Int. Cl.
*A63F 9/00* (2006.01)

(52) U.S. Cl. ..... 273/144 A; 273/144 R

(58) Field of Classification Search ..... 273/144 A, 273/138.1, 138.2, 138.3, 138.4, 139, 142 E, 273/142 F, 142 G, 144 R, 144 B, 269, 118, 273/119, 120, 121, 122, 123, 124, 125; 463/22, 463/17, 18, 19; D21/369, 371
See application file for complete search history.

(56) References Cited

U.S. PATENT DOCUMENTS 3,856,312 A * 12/1974 Dabrowski ..... 273/144 A
4,741,533 A * 5/1988 Michael ..... 273/144 B
4,877,246 A * 10/1989 Kropkowski ..... 273/144 R
4,887,816 A * 12/1989 Hanna ..... 273/144 A
4,961,578 A * 10/1990 Chateau ..... 273/144 R
5,634,639 A * 6/1997 Tokito et al. ..... 273/123 R
5,725,212 A * 3/1998 Garrett ..... 273/144 R
5,743,526 A * 4/1998 Inoue ..... 273/144 R
5,857,910 A * 1/1999 Watanabe et al. ..... 463/17
6,120,024 A * 9/2000 Lind ..... 273/144 R
6,164,646 A * 12/2000 Uehara et al. ..... 273/142 R
6,322,071 B1 * 11/2001 Chaaban ..... 273/138.4
6,520,374 B1 * 2/2003 Chang ..... 221/113
6,938,514 B1 * 9/2005 Crane et al. ..... 74/571.1

* cited by examiner

*Primary Examiner*—Corbett B Coburn
*Assistant Examiner*—Manjot K Dhillon
(74) *Attorney, Agent, or Firm*—patenttm.us

(57) ABSTRACT

A drawing machine has a base, a barrel, a cover, a blower, a ball selector, two curved tubes, a ball collector and two connector assemblies. The barrel is transparent to contain balls and has an access window. The cover is attached to the barrel to close the window. The blower is connected to the barrel to blow air into the barrel. The ball selector extends into the barrel to gather individually the balls. Two curved tubes are mounted in the base and are connected to the ball selector. The connector assemblies are connected respectively to the bottoms of the curved tubes. Each connector assembly has a motor and a connector. The connector is driven by the motor and has a passage and a guiding channel. The passage selectively communicates with one of the curved tubes. The guiding channel selectively corresponds to the ball collector.

4 Claims, 5 Drawing Sheets

DRAWING MACHINE FOR MULTIPLE GAMES

BACKGROUND OF THE INVENTION

1. Field of the Invention

The present invention relates to a drawing machine, and more particularly to a drawing machine for multiple games, such as Bingo, Lottery, tube Mahiong or Baccarat.

2. Description of Related Art

Bingo and Lottery are commonly conducted with a drawing machine that can randomly select numbered balls. A conventional drawing machine substantially comprises a base, a barrel, a blower, a ball selector and two curved tubes. The barrel is transparent to illustrate fairness and is mounted to the base to contain multiple numbered balls. The blower is mounted in the base and is connected to the barrel to blow air into the barrel. The ball selector extends into the barrel to gather individually the numbered balls. The curved tubes are mounted in the base and are connected to the ball selector. The bottoms of the curved tubes are connected to and communicated with the barrel. Accordingly, the air blown into the barrel from the blower will make the numbered balls irregularly jump inside the barrel, and the ball selector will catch one of the jumping balls so that Bingo or Lottery can be performed.

However, the conventional drawing machine can only fit with one game and cannot be applied with different games, so the conventional drawing machine is not versatile in use.

To overcome the shortcomings, the present invention tends to provide a drawing machine to mitigate or obviate the aforementioned problems.

SUMMARY OF THE INVENTION

The main objective of the invention is to provide a drawing machine for multiple different games and that is versatile in use. The drawing machine has a base, a transparent barrel, a cover, a ball-activating device, a ball selector, two curved tubes, a ball collector and two connector assemblies. The barrel is mounted in the base to contain multiple numbered balls and has an access window. The cover is attached to the barrel to close the window. The blower is mounted in the base and is connected to the bottom of the barrel to blow air into the barrel. The ball selector extends into the barrel to gather individually the numbered balls. The two curved tubes are mounted in the base, and each has a top connected to the ball selector, and a bottom. The ball collector is mounted in the base. The connector assemblies are connected respectively to the bottoms of the curved tubes. Each connector assembly has a motor and a connector. The motor is securely attached to the base and has a rotating shaft. The connector is attached to the rotating shaft and has a passage and a guiding channel. The passage is defined through the connector and selectively communicates with the bottom of a corresponding one of the curved tubes. The guiding channel is defined in the connector and selectively corresponds to the ball collector.

Other objects, advantages and novel features of the invention will become more apparent from the following detailed description when taken in conjunction with the accompanying drawings.

DETAILED DESCRIPTION OF PREFERRED EMBODIMENT

Figure 1:
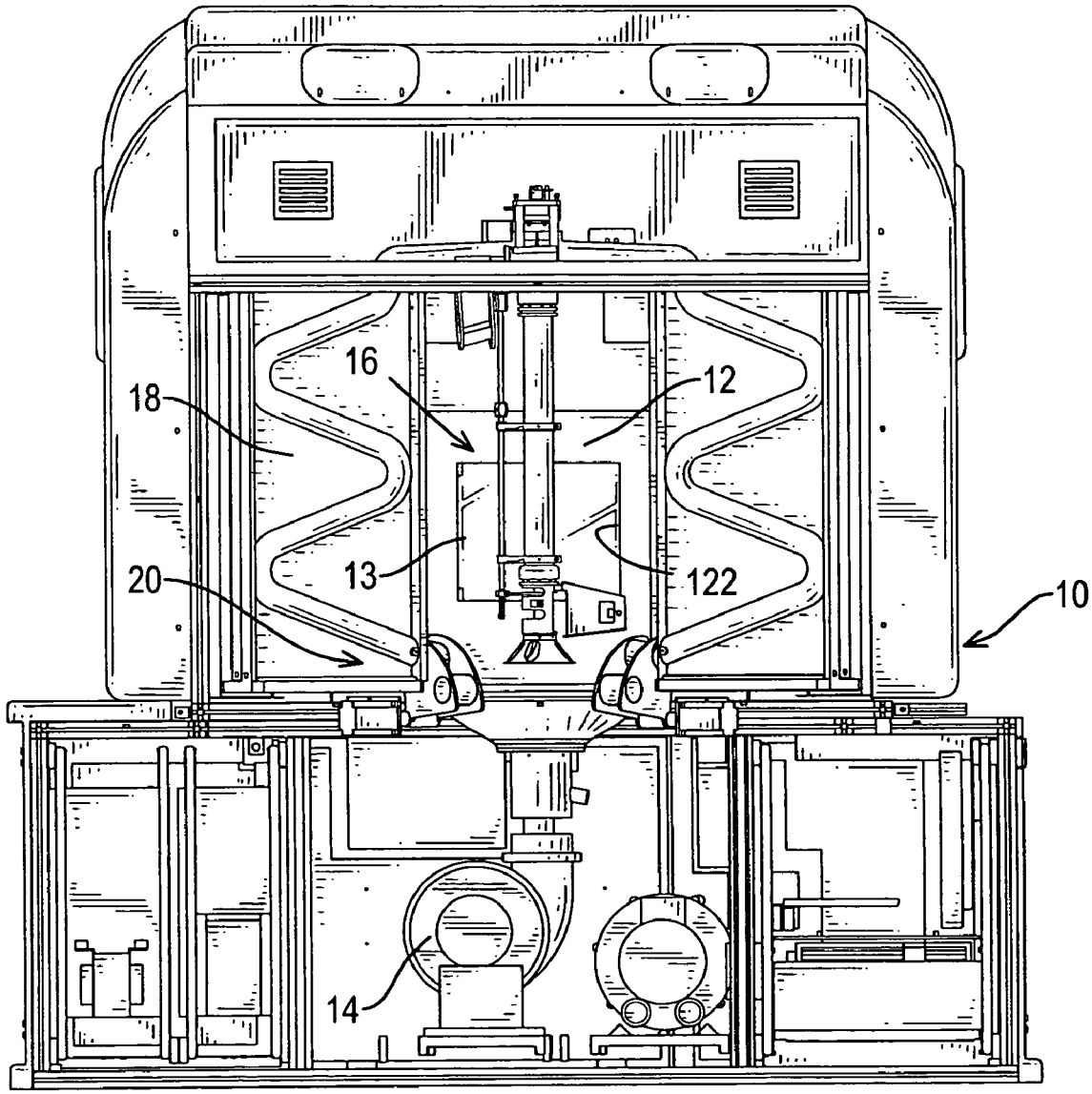
FIG. 1 is a front plan view of a drawing machine in accordance with the present invention.
Figure 3:
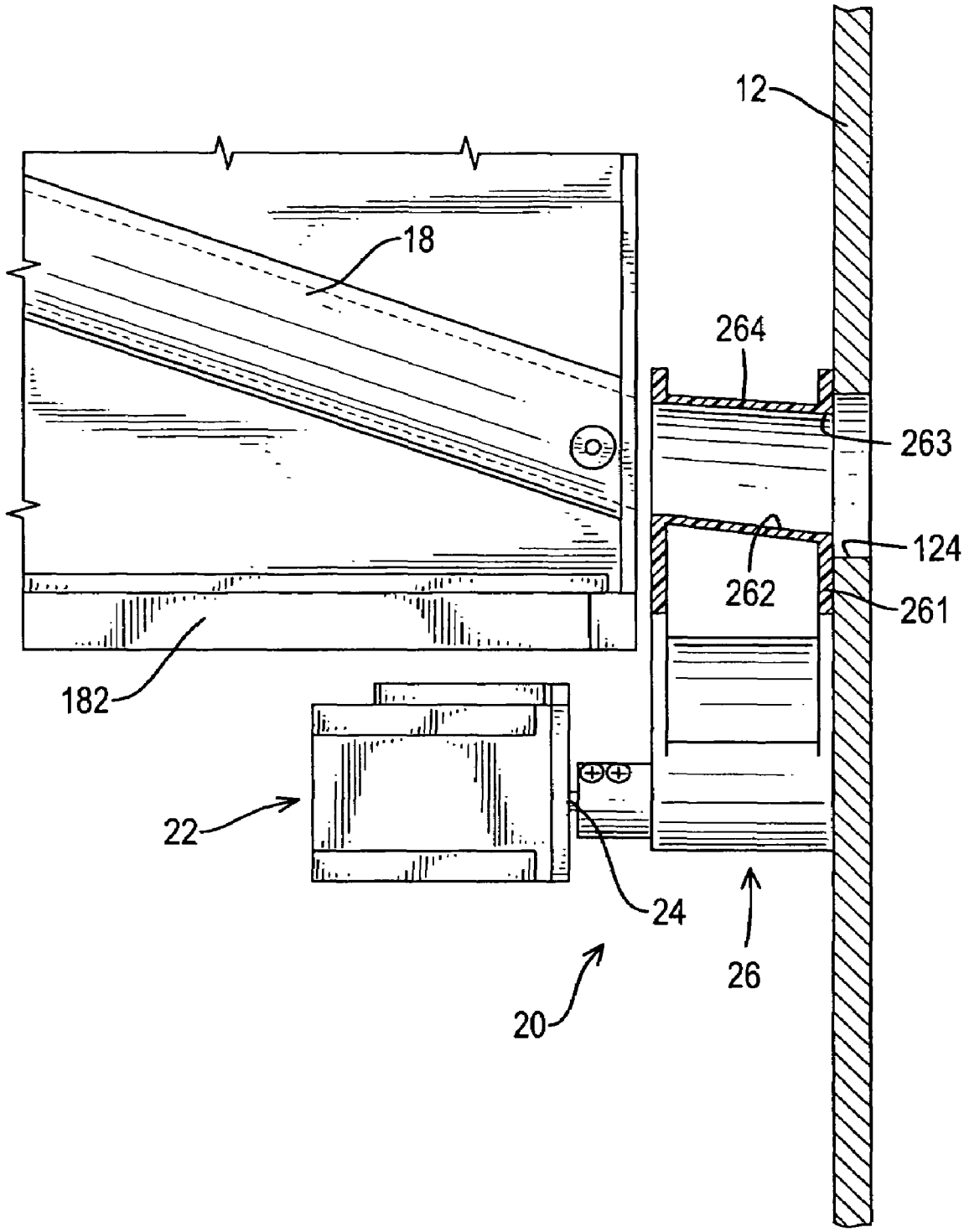
FIG. 3 is an enlarged side plan view in partial cross section of the curved tube and the connector assembly of the drawing machine in FIG. 2.
Figure 4:
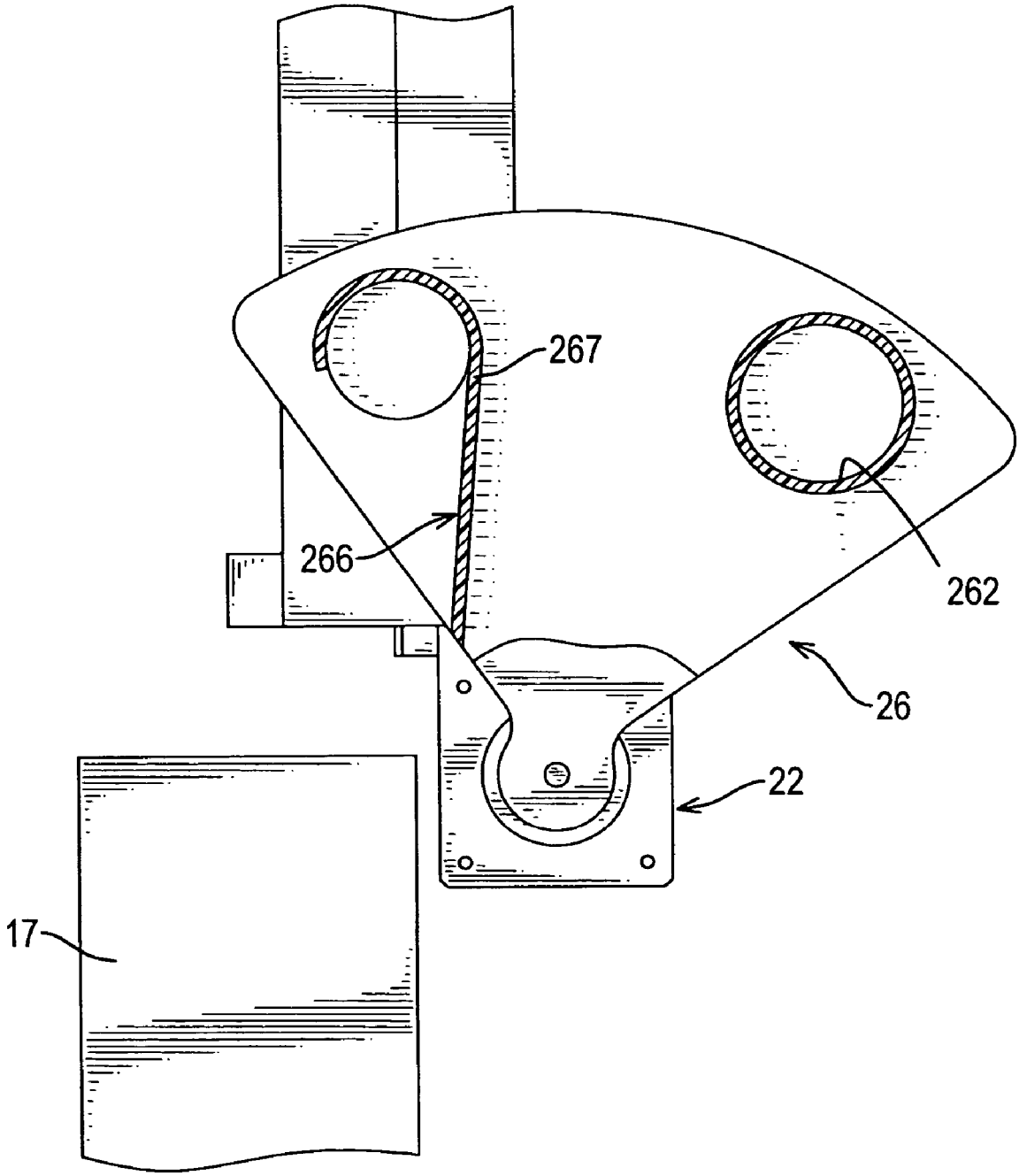
FIG. 4 is an enlarged side plan view in partial cross section of the curved tube and the connector assembly of the drawing machine in FIG. 2.

With reference to FIGS. 1, 3 and 4, a drawing machine in accordance with the present invention comprises a base (10), a barrel (12), a cover (13), a ball-activating device (14), a ball selector (16), two curved tubes (18), a ball collector (17) and two connector assemblies (20). The barrel (12) is transparent and is mounted in the base (10) to contain multiple numbered balls. The barrel (12) has a top, a bottom, a window (122) and two ball inlets (124). The window (122) and the ball inlets (124) are defined in the barrel (12). The cover (13) is attached to the barrel (12) to close the window (122).

The ball-activating device (14) is mounted in the base (10) and is connected to the bottom of the barrel (12) to activate the balls in the barrel (12) to jump randomly. In a preferred embodiment, the ball-activating device (14) is a blower. The ball selector (16) extends into the barrel (12) to gather individually the numbered balls. In general, the ball selector (16) has a number-detecting device to detect the number of the chosen ball. In an operation embodiment, the number-detecting device can be a video camera, chip-detecting device or a barcode reader. The structures of the ball-activating device (14) and the ball selector (16) can be same as that of conventional ones and are not further described.

Figure 2:
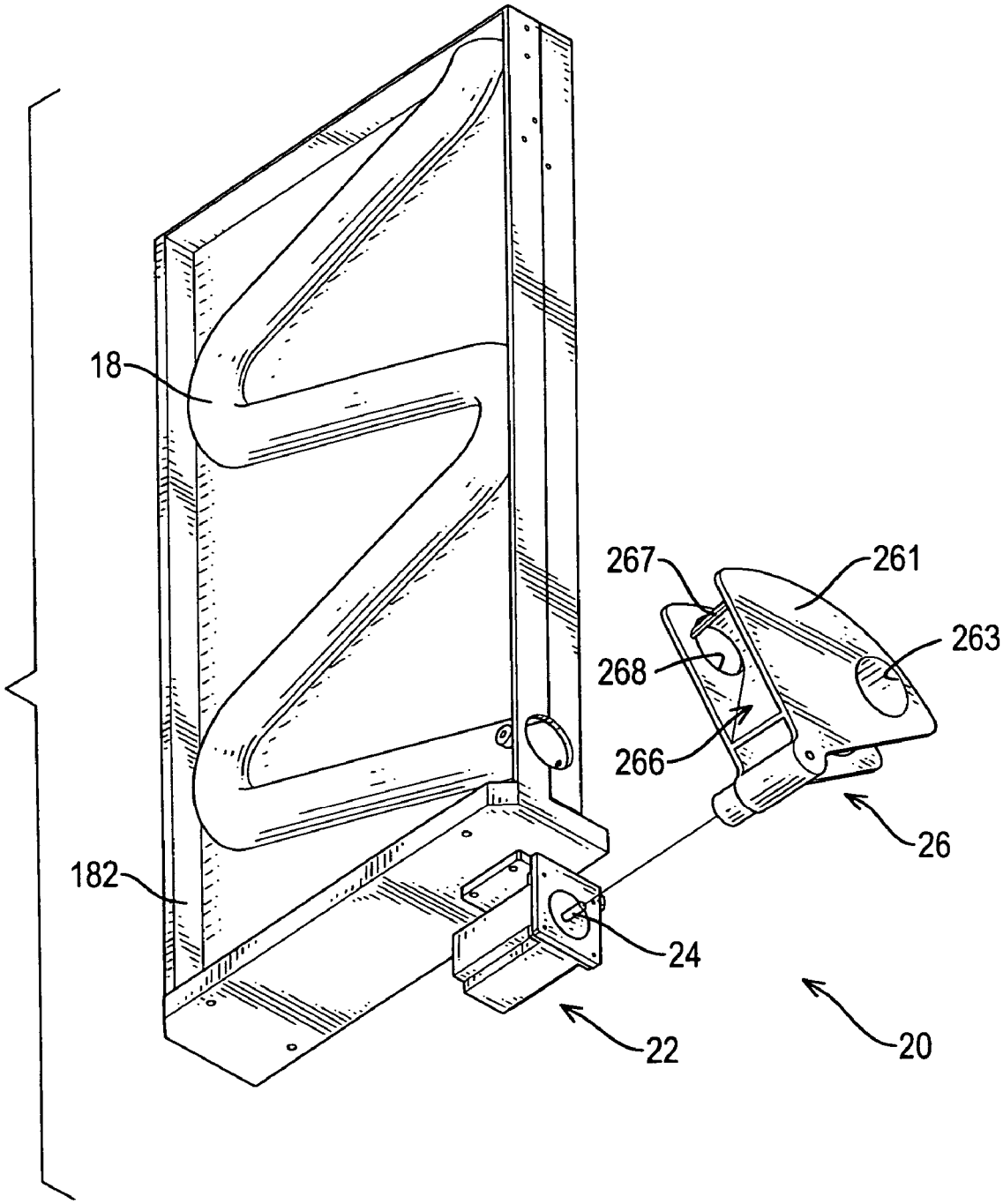
FIG. 2 is an exploded perspective view of one curved tube and a connector assembly of the drawing machine in FIG. 1.

The curved tubes (18) are mounted in the base (0) respectively at two sides of the barrel (12), and each has a top connected to the ball selector (16) and a bottom. The bottoms of the curved tubes (18) are aligned respectively with the ball inlets (124) in the barrel (12). In a preferred embodiment, with further reference to FIG. 2, the drawing machine further has two frames (182), and the curved tubes (18) are respectively mounted in the frames (182).

The ball collector (17) is mounted inside the base (10). In an optional embodiment, the ball collector (17) is a box for storing balls.

The connector assemblies (20) are connected respectively to the bottoms of the curved tubes (18). Each connector assembly (20) comprises a motor (22) and a connector (26). The motor (22) is securely attached to the base (10), especially to the frame (182), and has a rotating shaft (24). The connector (26) is attached to and rotates with the rotating shaft (24) of the motor (22). The connector (26) has a passage (262) and a guiding channel (266). The passage (262) is defined through the connector (26) and selectively communicates with the bottom of a corresponding one of the curved tubes (18) and one of the ball inlets (124) in the barrel (12). The guiding channel (266) is defined in the connector (26) and selectively corresponds to the ball collector (17). In an optional embodiment, each connector (20) is composed of two side plates (261), a connecting tube (264) and a guiding plate (267). The connecting tube (264) is mounted between the side plates (261) and has a central hole to serve as the passage (262) in the connector (26). The guiding plate (267) is mounted between the side plates (261) and is curved to define the guiding channel (266) between the plates (261).

Each side plate (261) has a bore (263) communicating with the central hole in the connecting tube (264). The side plate (261) that faces the corresponding curved tube (18) has a through hole (268) corresponding to and communicating with the guiding channel (266) formed by the guiding plate (267).

Accordingly, after opening the cover (13), balls corresponding to a specific game, such as Bingo, Lottery or Baccarat are put into the barrel (12) through the access window (122). When the ball-activating device (14) is powered on, air will be blown into the barrel (12) to make the balls irregularly jump inside the barrel (12). The ball selector (16) will gather one ball and lead the ball into one of the curved tubes (18), such that the specific game is proceeded by gathering balls in the barrel one by one. At this time, each connector (26) is rotated to a position where the bottom of the corresponding tube (18) aligns with a portion of the connector (26) beside the passage (262) and the guiding channel (266). Consequently, the chosen balls will be blocked by the connectors (26) and are kept inside the tubes (18), such that the chosen balls can be checked and will not enter the barrel (12) before the connectors (26) are rotated to align the passages (262) with the bottoms of the tubes (18).

When the user wants to play a different game, the ball selector (16) gathers all of the balls in the barrel (12) and transfers them to the curved tubes (18). The motors (22) of the connector assemblies (20) are turned on to rotate the connectors (26) and to make the guiding channels (266) in the connectors (26) align with the curved tubes (18). Accordingly, the balls will be led into the ball collector (17) through the guiding channels (266) in the connectors (26). Then, balls for the new game are put into the barrel (12) through the access window (122), and the user can play the new game with the drawing machine.

Figure 5:
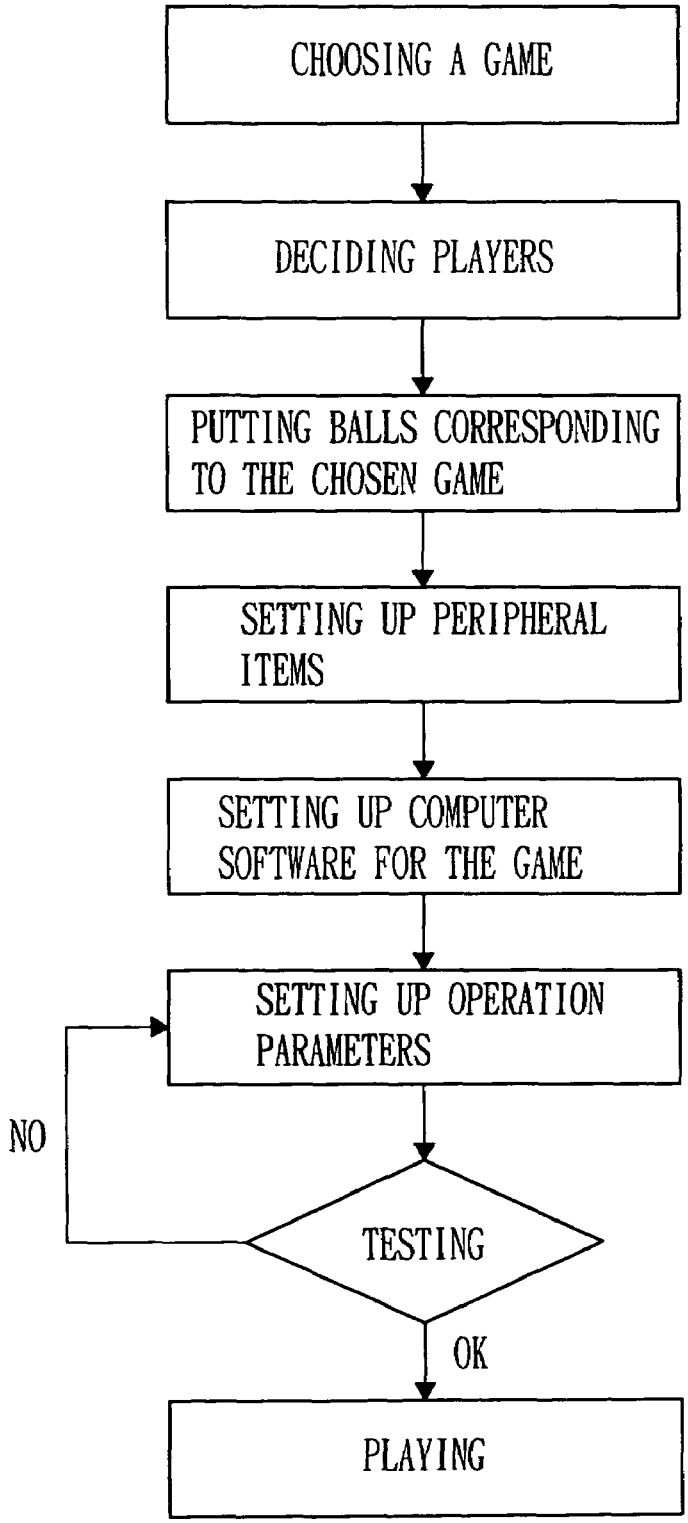
FIG. 5 is flow chart of a method of using the drawing machine in FIG. 1 with multiple games.

With reference to FIG. 5, a method for playing different games with the drawing machine in accordance with the present invention comprises the acts as follow:

a) choosing a game: To choose a game, such as Bingo, Lottery, to be played.

b) deciding players: To decide the number of players playing the chosen game.

c) putting balls corresponding to the chosen game. To put balls corresponding to the chosen game inside the barrel.

d) setting up peripheral items: To set up peripheral items that are used during the chosen game.

e) setting up computer software for the game: To set up a computer software corresponding to the chosen game into a computer arranged in the drawing machine.

f) setting up operation parameters: To set up operation parameters for the computer software to play the chosen game.

g) testing: To test the operation condition of the software with the inputted operation parameter. If the software cannot work as desired, to input different operation parameters into the software.

h) playing: If the software can work as desired, to play the game.

With such a method and a drawing machine, the user can play different games conveniently, and the use of the drawing machine is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drawing machine comprising: a base; a transparent barrel mounted in the base to contain multiple numbered balls and having a top, a bottom, an access window and two ball inlets; a cover attached to the barrel to close the access window; a ball-activating device mounted in the base and connected to the bottom of the barrel to activate the balls to randomly jump in the barrel; a ball selector extending into the barrel to gather individually the numbered balls; two curved tubes mounted in the base and each having a top connected to the ball selector and a bottom corresponding to one of the ball inlets in the barrel; a ball collector mounted in the base; and two connector assemblies connected respectively to the bottoms of the curved tubes and each comprising a motor securely attached to the base and having a rotating shaft; and a connector attached to the rotating shaft and having a passage defined through the connector and selectively communicating with the bottom of a corresponding one of the curved tubes and one of the ball inlets in the barrel to allow the balls entering the barrel through the passage; and a guiding channel defined in the connector and selectively corresponding to the ball collector to lead the balls to enter the ball collector through the guiding channel, wherein each connector is composed of:

two side plates;

a connecting tube mounted between the side plates and having a central hole to serve as the passage in the connector; and a guiding plate mounted between the side plates and being curved to define the guiding channel between the side plates, wherein each side plate has a bore communicating with the central hole in the connecting tube;

wherein the side plate that faces the corresponding curved tube has a through hole corresponding to and communicating with the guiding channel formed by the guiding plate, wherein each connector has a capability of blocking the balls when the connector is rotated to a position where the bottom of the corresponding curved tube connector is rotated to a position where the bottom of the corresponding curved tube aligns with a portion of the connector beside the passage and the guiding channel.

2. The drawing machine as claimed in claim 1 further comprising two frames mounted in the base, wherein the curved tubes are respectively mounted in the frames.

3. The drawing machine as claimed in claim 2, wherein the motor of each connector assembly is attached to a corresponding one of the frames.

4. The drawing machine as claimed in claim 3, wherein the activating device is a blower.

* * * * *